United States Patent [19]

Johnson

[11] Patent Number: 4,508,352

[45] Date of Patent: Apr. 2, 1985

[54] MOUSE TRAP GAME

[76] Inventor: William C. Johnson, 743 N. Grand Ave., Glendora, Calif. 91740

[21] Appl. No.: 529,390

[22] Filed: Sep. 6, 1983

[51] Int. Cl.[3] ..... A63F 3/00

[52] U.S. Cl. ..... 273/274; 273/139

[58] Field of Search ..... 119/17; 273/274, 142 F, 273/142 G, 139; 312/117, 118, 122, 123, 234.3

[56] References Cited

U.S. PATENT DOCUMENTS

| | | | |
|---|---|---|---|
| 346,896 | 8/1886 | Cooper | 312/122 |
| 630,505 | 8/1899 | Hicks | 312/117 X |
| 693,469 | 2/1902 | Wagner | 312/117 X |
| 1,565,388 | 12/1925 | Paullin | 312/117 |
| 2,014,516 | 9/1935 | Beddingfield | 312/118 |
| 2,084,701 | 6/1937 | Paul | 273/139 |
| 2,193,896 | 3/1940 | Angst | 273/142 F |
| 4,232,866 | 11/1980 | Pennachio | 273/274 |
| 4,402,280 | 9/1983 | Thomas | 119/17 X |

FOREIGN PATENT DOCUMENTS

| | | | |
|---|---|---|---|
| 2448915 | 10/1980 | France | 273/274 |

OTHER PUBLICATIONS

John Scarne, "Scarne's Complete Guide to Gambling", 1961, pp. 468, 469, to The Mouse Game.

*Primary Examiner*—Harland S. Skogquist
*Attorney, Agent, or Firm*—Wm. Jacquet Gribble

[57] ABSTRACT

A game board with a top surface divided into zones of differing colors radiating from a central release spot has downward apertures near the outer edge of each zone adjacent a fence that surrounds the board. A trap cup seals off each aperture to prevent the escape of a rodent or other small animal used in the game as a random selector. The cup may be transparent so all players may see into which cup the rodent runs. Around the game board, which may be rotatable, are banks of players' segments, each segment being colored to match a color zone of the game board, with the exception of a "house" color. A transparent hood is secured above the players' segments by hinges, while the inner frame of the segments gives access to a monitor within the area defined by the banks of segments and the game board. Odds placards may be posted on each segment. While the board is slowly rotated a field mouse, pocket gopher or other small animal is released at the center of the board at the release spot on the colored surface to scramble across the board to hide in one of the apertures at the outer edge of a zone. The player whose tokens are on a segment having the same color as the color of the aperture zone chosen by the animal selector is the "winner".

5 Claims, 8 Drawing Figures

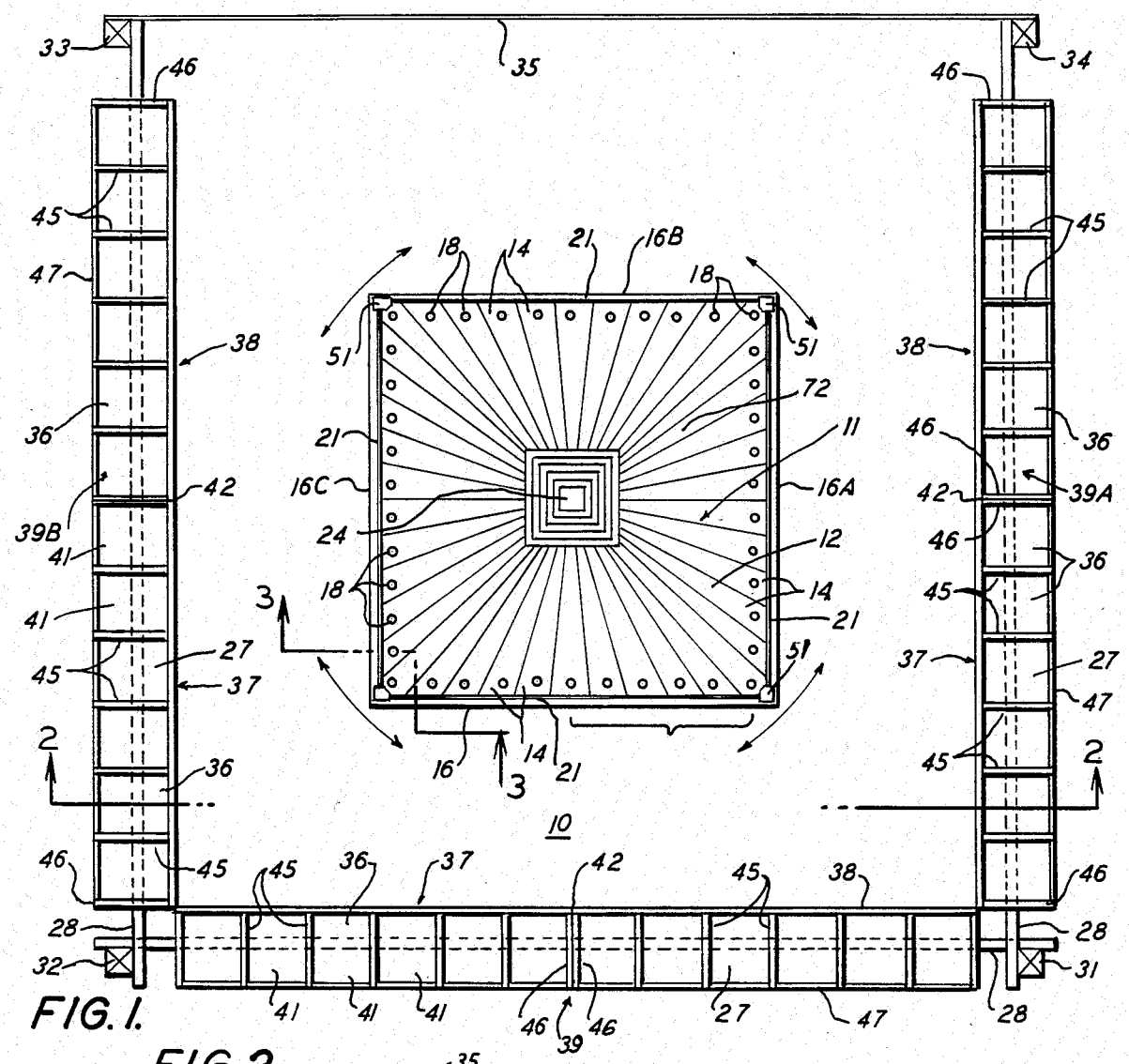
FIG. 1.
FIG. 2.
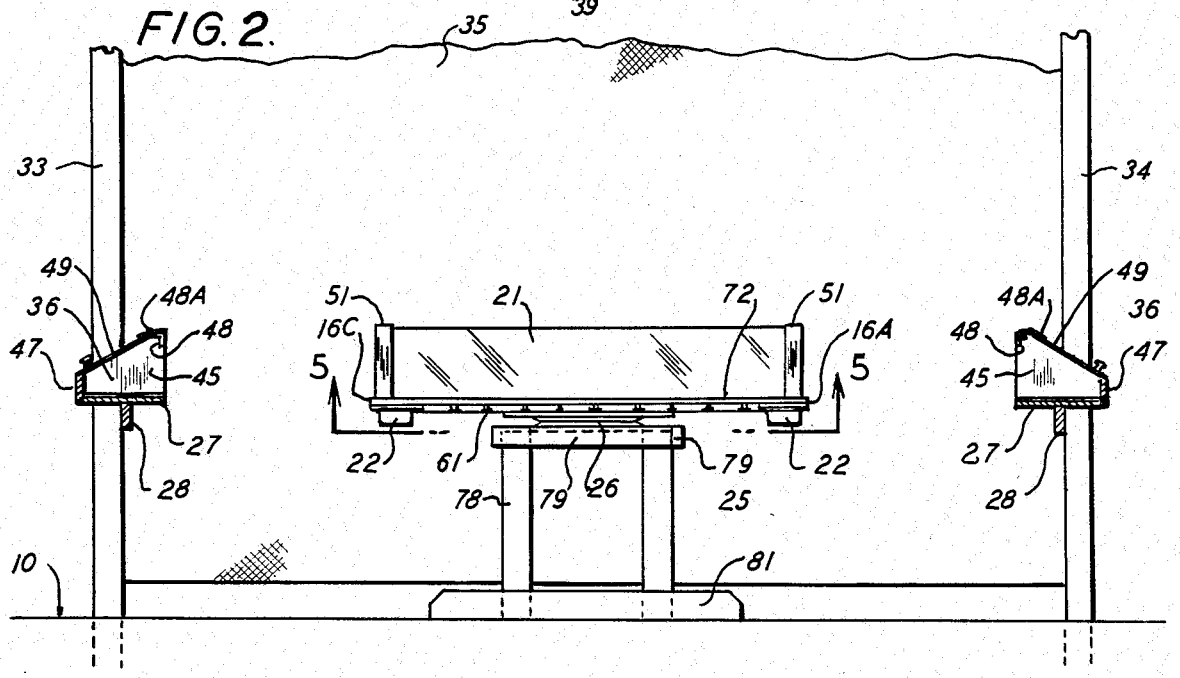

MOUSE TRAP GAME

BACKGROUND OF THE INVENTION

Many games of amusement or chance, such as those games used at fairs and carnivals, utilize random or chance election of a number to determine winners of various prizes or prize tokens. Wheels of fortune, roulette wheels, darts and balls thrown at targets represent some games using random winner selection as amusement. Other attempts to present games with randomly selected winners apart from those listed have been made over the years and a preliminary search of prior patents has disclosed some related, but not anticipatory past patents from Class 119, Subclass 29; Class 272, Subclass 19; Class 273, Subclasses 138, 236, 398, 139 and 287.

The discovered patents range in age from those issued in the 1950s to that issued in the 1980s, and include:

U.S. Pat. No. 2,525,716, Okamoto
U.S. Pat. No. 3,895,808, Averette
U.S. Pat. No. 3,927,880, Petrusek
U.S. Pat. No. 3,989,252, Mattson
U.S. Pat. No. 4,039,193, Slater
U.S. Pat. No. 4,076,251, Hornsby.

While each of these patents represents inventive skill of one sort, or another, none found employs a live animal as a random selector. Thus none offers the novelty, the uncontrolled conduct, or the honesty of applicant's game.

SUMMARY OF THE INVENTION

The invention contemplates process and apparatus for a game of chance for a plurality of participants and employing a live animal as a random selector in which a selector arena has a plurality of color distinctive zones within upright shields at the periphery of the arena, pivot means supporting said arena, a multiplicity of peripheral selector apertures, one at the outer end of each color distinctive zone, and a receptacle or cup under each aperture adapted to receive an animal descending through an aperture from the arena top surface, each cup being releasably secured beneath an aperture so that a rodent or other animal may be returned to a central release spot defined on the arena surface. A plurality of player choice segments each having a color to match one of the arena surface zone colors is provided with transparent shields closing the choice segments to participants, while leaving the segments accessible to an operator within the area bounded by the alignment of choice segments about the selector arena. The transparent shields or hoods are displaceable from closed position to give participants access thereto to place selection indicators on the segment chosen. Odds may be marked upon each choice board segment to indicate probabilities of the animal selector entering an aperture at the end of an arena zone of the same color.

The game afforded by the apparatus of the invention is used by first raising the transparent hoods to give players access to the choice segments, players' placement of selection tokens on one or more segments, closing of the hoods followed by releasing a selector animal at the center of the game board, rotating the game arena to induce motion by the animal selector toward the apertures and recapture of the selector in a trap cup below the arena, sweeping the tokens from the segments through the open frames of the segment and doling out to winners tokens or prizes commensurate with the odds posted on winning segments.

The inventive game is one of high excitement and amusement due to the unpredictable antics of the live random selectors and the inducement of a game where skilled players do not have an advantage compared to novices. Also, there is nothing an operator can do to influence the antics of the live random selector so that players are assured of a game where all selection factors are out in the open.

The game apparatus may be fabricated from conventional materials such as dimensional lumber with standard tools, and cost is therefore minimized. All ages and physical endowments are acceptable in players and all can enjoy the play. These and other advantages of the invention are apparent from the following detailed description and drawing.

BRIEF DESCRIPTION OF THE DRAWING

FIG. 1 is a top plan view of a preferred embodiment of the inventive apparatus;

FIG. 2 is a fragmentary sectional elevational view taken along line 2—2 of FIG. 1;

DESCRIPTION OF THE PREFERRED EMBODIMENTS

Figure 3:
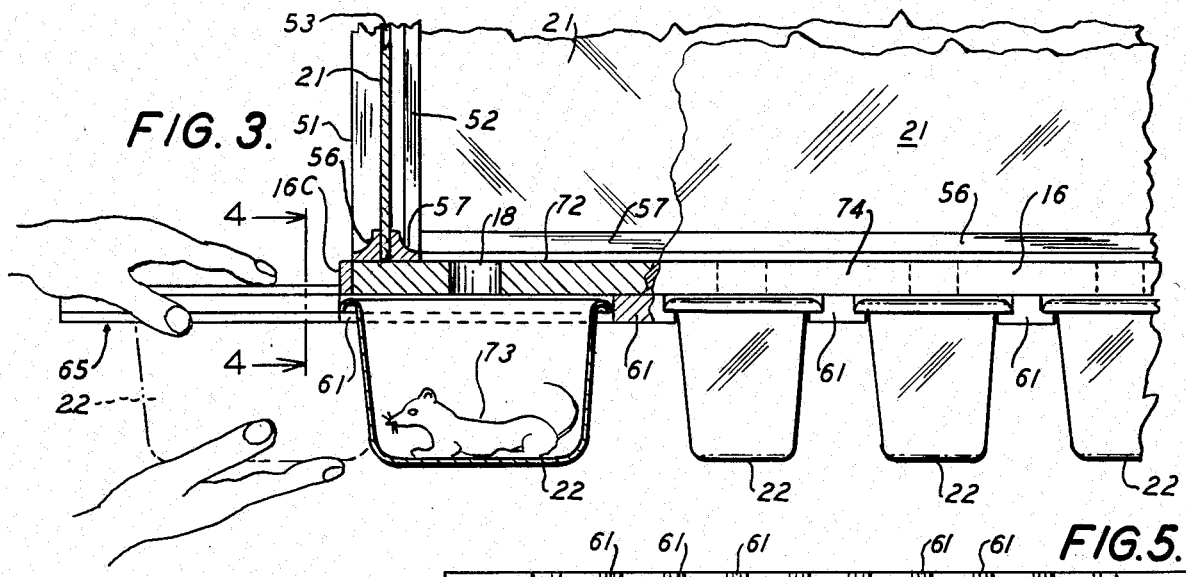
FIG. 3 is an enlarged fragmentary sectional view taken along line 3—3 of FIG. 1.

In FIGS. 1 and 2 the game apparatus of the invention is shown to a reduced scale in place upon a ground site 10. A selector arena 11 in FIG. 1 has a top surface 12 having a plurality of radial, color distinct zones 14 dividing the top surface into zone groups such as a group 15 of six colors extending inwardly from the lower edge 16 of arena 11. Each edge 16, 16A, 16B and 16C is similarly the terminator for groups of colored zones, the colors being arbitrarily chosen to be green, dark blue, light blue, red, white, grey and yellow. At the outer edge of each radial zone a vertical selector aperture 18 extends through the arena floor. There are eleven selector apertures adjacent each edge 16, 16A, 16B and 16C. Each edge also has a transparent fence 21 reaching about twelve inches above the arena top surface 12 and the length of each edge to deter departure by the small animal from the arena except by way of an aperture into a cup.

Beneath each selector aperture a trap cup 22 is releasably secured, like those shown in FIG. 2 associated with edges 16A and 16C. The cups are metallic, but may be transparent so participants may see the trapped selector rodent at the end of a game round.

A central release zone 24 is defined at the center of the arena, either by a painted pattern of concentric squares or by an applied decal of similar configuration. From this central location on the arena a small rodent, such as a field mouse or pocket gopher, is loosed. The arena may be rotated upon a platform 25, seen in FIG. 2 with its pivot mount 26, as the rodent runs. The arena is preferably rotated manually, although the invention does not preclude mechanical or electrical rotation of the arena.

The arena 11 is surrounded by banks of participant choice boards shown at 3 sides of the arena. 2 or 4 sides may be used depending upon available space. Participants standing at the banks 27 place tokens on the choice boards to indicate thereon their prediction of the zone color of an aperture 18 the rodent will enter. A rail 28 supports each board bank 27 and is fixed at its ends to 2 of upright posts 31, 32, 33, 34 placed at corners of the playing area. Posts 33, 34 at the rear of the playing area suspend a screen 35 of canvas or wire to delineate the participant boundaries and to close the space around the arena to all but game operation personnel.

Figure 6:
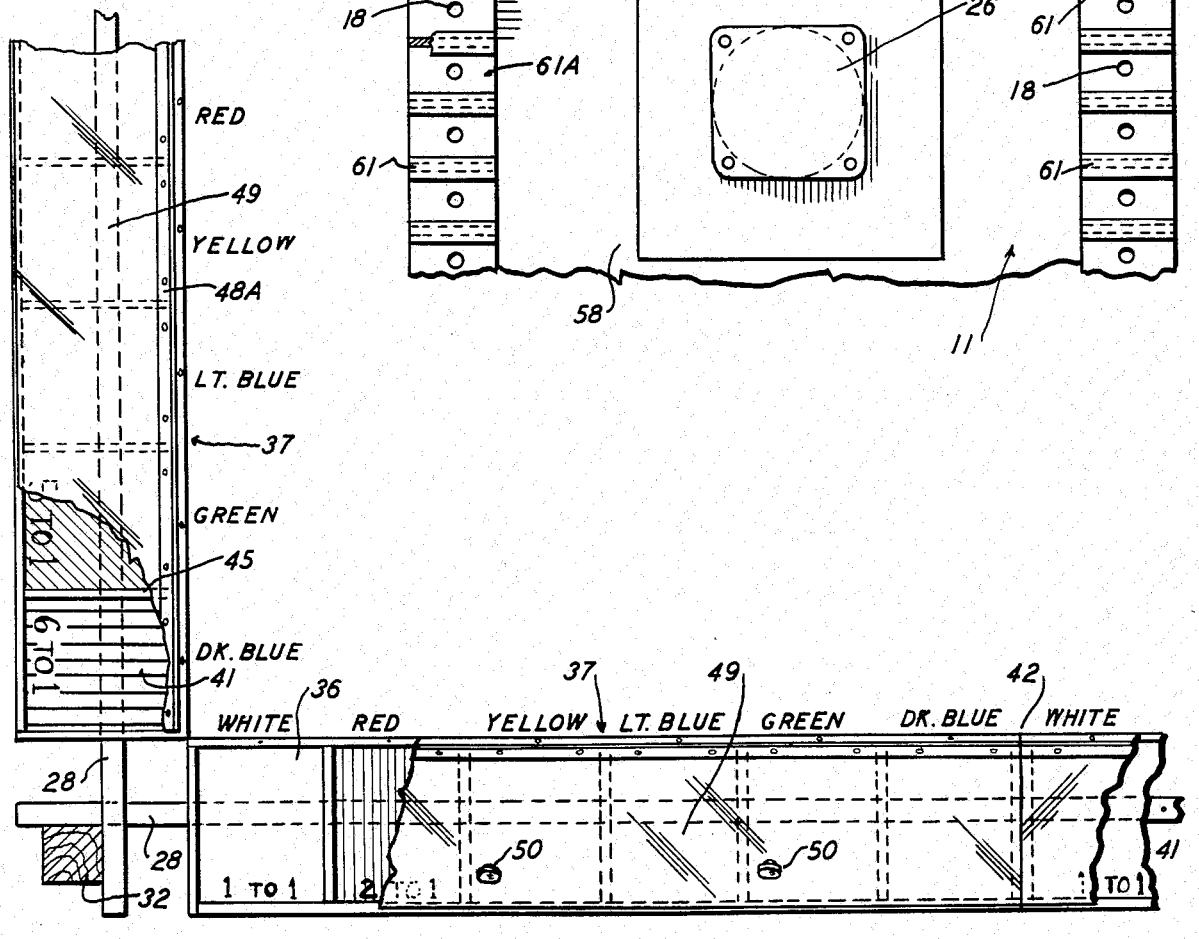
FIG. 6 is a fragmentary plan view of the participant choice banks, partly broken away.

Each bank 27 of choice boards comprises 2 identical boards butting together at the center of each rail 28. Each choice board has 6 token segments 36, each matched to one of 6 of the 7 radial zone colors. Thus, each of the choice boards 37, 38 seen in FIG. 6 comprising a bank 39, is parallel to arena edge 16 and has a token segment floor 41 of a different color, with each segment floor also having a decal or painted legend 41A indicating the reward odds for selecting the proper zone of the entered selector aperture.

Banks 39A and 39B are also divided into two similar boards 37, 38 joined at 42, so that participants have access to a view of the arena from three sides and a selection or choice of six choice boards each having six token segments.

Each of choice boards 37 and 38 has a number of divider walls 45 transversely separating the token segments, and two end walls 46. Blocks 47 form a front retainer between each divider wall pair. A stringer 48 at the inner butt of each divider, which may be of iron or aluminum angle, provides a hinge mount for hinges 48A of transparent hoods 49 closable over token segments 36. The inner portion of each token segment is open to the game operator for removal of tokens when a game phase is over. Each hood has a lift handle 50.

Figure 4:
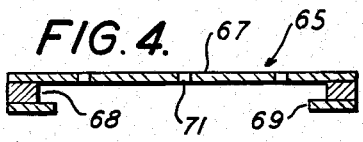
FIG. 4 is a fragmentary sectional elevational view taken along line 4—4 of FIG. 3.
Figure 5:
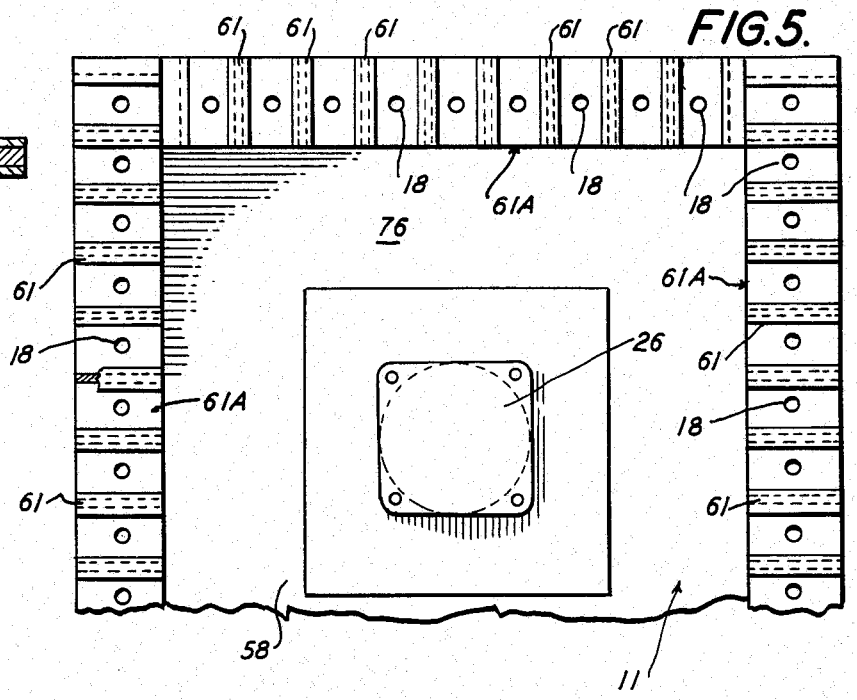
FIG. 5 is a bottom sectional plan view, partly broken away, taken along line 5—5 of FIG. 2.

FIGS. 3, 4 and 5 show in more detail the elements of arena 11 and the securing arrangement for trap cups 22. For better comprehension the elevational view of FIG. 3 is fragmentary and partly broken away to enlarge the drawing scale and to show construction. Three of the four fences 21 of the arena are visible in that Figure, with two of the fences shown supported at their ends in a corner post 51. The post has a bevelled inner face 52 (see FIG. 8) and vertical grooves 53 in two post faces at right angles to each other. Each groove accepts a fence end 54 so that the four corner posts shown in FIGS. 1 and 8 hold all four fences 21 upright. For added security against penetration, and for esthetic reasons, moulding strips 56, 57 are fixed respectively to the outer and inner sides of the fence at its bottom. The moulding strips are nailed or glued to an arena base 58 through which selector apertures extend to trap cups 22. Base 58 bears the colored radial zones 14 of the top surface 12.

As shown in FIG. 5, cleats 61 between selector apertures 18 are grooved to accept flanges molded at 62 on the upper rims of cups 22, so that each trap cup may be removed, as shown in FIG. 3, from its cleat pair and covered with a perforated lid like lid 65 of FIG. 4.

Lid 65 may be molded with parallel lips 66 at opposite sides spaced from cover 67, or, as shown in FIG. 4, lesser and greater strips 68, 69 may respectively be fixed to the cover at its bottom side to define the supporting lips. Cover 67 has breathe holes 71 to sustain the life of the enclosed rodent.

Figure 7:
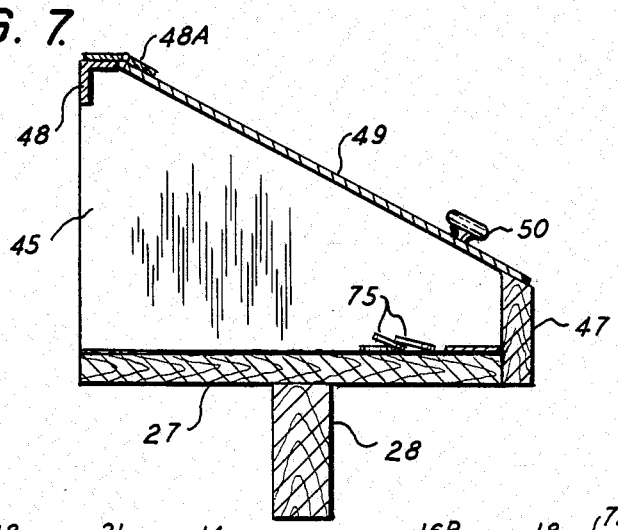
FIG. 7 is a transverse sectional elevational view of a participant's choice segment to a larger scale.

In FIG. 3 the rodent, a field mouse 73, has opted for an aperture 18 in a radial zone colored red. All participants with tokens like those tokens 75 of FIG. 7 on a red segment are deemed winners and are rewarded in accord with the indicated odds, in this case at the ratio of two to one, as indicated by the legend "2 to 1" that is painted, or printed on an applied decal upon floor 41 of the choice segment. Since there are six similar token segments there may be six "winners" or more, if several players place tokens on a single segment.

Figure 8:
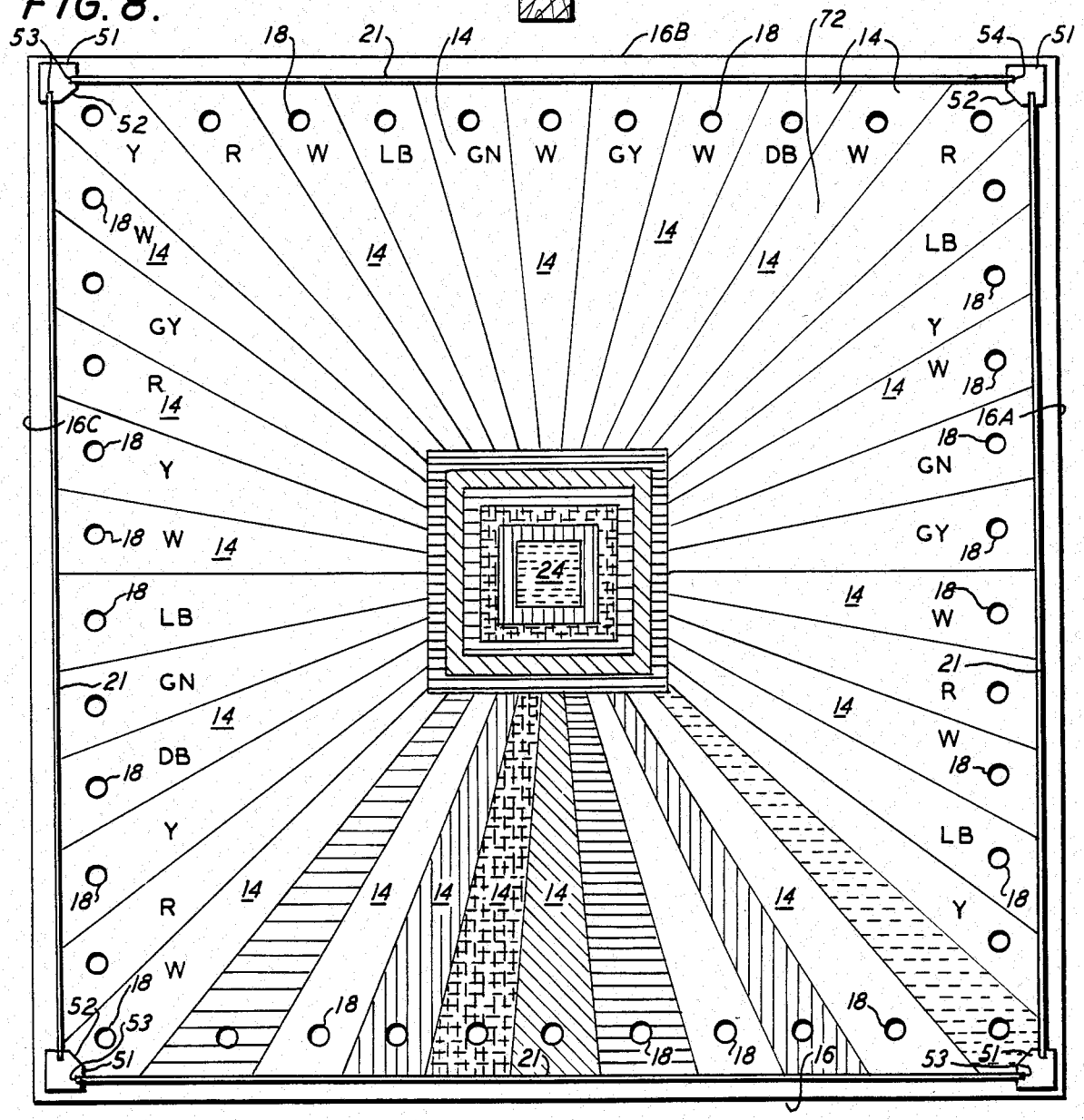
FIG. 8 is a plan view layout of the top surface of the arena to a larger scale.

As can be seen from the larger scale drawing of FIG. 8, the arena 11 has radial zones 14 of seven different colors while choice segments of banks 37, 38 have only six colors represented, thus providing a "house" color zone, usually grey, in which participants do not share in victory.

While the arena of the inventive apparatus may be constructed in many different ways, the preferred embodiment is illustrated in FIGS. 3 and 5, where arena 11 is comprised of a planar floor 72 of base 58, from which corner fence posts 51 rise to support fences 21. Moulding 56, 57 is fixed to base 58 and base edges 16–16C are covered by trim strips 74. The selector apertures 18 penetrate floor 72 and cleats 61 depend from the bottom surface of the base. The cleats may be fixed directly to the floor base 58 as shown in FIG. 3 or may be preassembled in banks 61A as shown in FIG. 5, which are then fixed to the undersurface 76 of the base. The banks could then each be routed from a thick plank the approximate length of an edge 16 and split into segments of the proper width to accept trap cups. The platform 25 supporting pivot mount 26 is preferably made from 2" by 4" wood and has four uprights 78 bound at the top by ties 79 bolted or nailed to the uprights. Base members 81 may be wide enough to afford stability to the arena when it is rotated without extending beyond the top surface periphery. When an arena that is approximately 60" square is used, then members 81 may be 44" along the ground or support floor. Top surface 12 is preferably situated 31" above the ground.

Color zones 14 are shown in FIG. 8 with one area of the arena top surface marked in conventional color code, with those zones all terminating at edge 16 being delineated from left to right from corner post 51 as white, light blue, white, red, yellow, green, dark blue, white, red, white and grey. The adjacent zones along edge 16A are yellow, light blue, white, red, white, grey, green, white, yellow and light blue. Starting from upper right post 51 the color zones are red, white, dark blue, white, grey, white, green, light blue, white and red. From upper left post 51 down along edge 16C the color zones are yellow, white, grey, red, yellow, white, light blue, green, dark blue, yellow and red.

The central zone 24 from which the selector rodent is released may be colored in square bands in similar fashion staring with a center square of grey and working outward to a final band of dark blue. Since the rodent is released from a similarly colored central zone, there is theoretically no pre-disposition because of the release zone toward any radial zone color on the part of the animal.

It has been found that field mice captured from the fields are best suited to the game process. A normal mouse "plays" the game for about one hour before being retired to a remote relaxation area for rest, food and water. Other small animals do not retain the ability to repeat the routine for that long. Since there is always a suspicion that certain trap cups could be biased by food odors or the like, the participating rodents are fed, watered and rested away from the game area. There seems to be no limit to the time period for which a rodent is adapted to engage in the game activity without harm so long as adequate rest between one hour stints is observed.

The inventive process includes the steps of dividing the planar arena into a plurality of distinctively colored radial zones each terminating outwardly in a selector aperture, trapping a rodent in a trap cup beneath an aperture after its release in a central zone of the arena from a release area colored like the radial zones. Token segment boards are set up around the arena with segments matching the colors of the radial zones. A hood is closed over the the token segments after participants have used the segment boards to indicate a selector aperture choice. A small rodent or other animal is released from the central release area to run toward a peripheral selector aperture and the arena is rotated as it runs. After the animal is captured in the trap cup beneath an aperture each participant whose choice on the token segment matched the animal selector performance is rewarded in accordance with the odds registered in his token segment. The trap cup may be removed from beneath the selector aperture to be shown to participants to assure that correct winners rewards are given.

Other modifications than those shown and described above may occur, within the scope of the invention, to those who may be skilled in this art. It is therefore desired that the invention be measured by the appended claims rather than by the illustrative material for process and apparatus set forth herein.

I claim:

1. In a game of chance for a plurality of participants and employing a live small animal the combination comprising a selector arena, vertical transparent fences on the periphery of said arena, stable means supporting said selector arena, a multiplicity of peripheral selector apertures, a trap cup beneath each selector aperture, means releasably securing each cup, a central release area defined on said arena, a color distinct zone extending from said central release area to each peripheral selector aperture, a plurality of participant choice boards each having a color segment matching one of the color zones on the selector arena, transparent hoods movably secured above each choice board, and means for displacing said transparent hoods from above said choice board to afford access thereto by a participant.

2. Apparatus in accordance with claim 1 further comprising a central arena support, and pivot means between said support and said arena.

3. Apparatus in accordance with claim 1 further comprising trap cup rims at the upper edge of each cup, pairs of cleats on each side of each selector aperture projecting from the lower surface of said arena, each cleat being grooved to receive a rim of a trap cup, and a perforated cover having side lips adapted to engage said trap cup rims.

4. Apparatus in accordance with claim 1 wherein said selector arena comprises a base, radial zones dividing the upper surface of said base into groups of differently colored zones, concentric color bands defining a release zone, a vertical corner post at each corner of said base, each corner supporting two fences, a bank of trap cup cleats fixed to the under side of said base, and a plurality of trap cups each having an outwardly protruding rim on opposite sides of the upper end of said cup adapted to fit pairs of said cleats.

5. Apparatus in accordance with claim 1 wherein said participant choice boards have segments representing one less color than said radial selector zones.

* * * * *